United States Patent [19]

Nanjo et al.

[11] 4,204,509

[45] May 27, 1980

[54] CURRENT INTERRUPTION TYPE IGNITION SYSTEM FOR AN INTERNAL COMBUSTION ENGINE

[75] Inventors: Hirotoshi Nanjo, Susono; Takeshi Watanabe, Fuji both of Japan

[73] Assignee: Kokusan Denki Co., Ltd., Numazu, Japan

[21] Appl. No.: 921,714

[22] Filed: Jul. 3, 1978

[30] Foreign Application Priority Data

Jul. 6, 1977 [JP] Japan ..... 52-80591

[51] Int. Cl.[2] ..... F02P 1/00

[52] U.S. Cl. ..... 123/148 E; 322/91; 315/218; 310/70 A

[58] Field of Search ..... 123/148 E, 149 D, 149 R; 315/218; 322/91; 310/70 A

[56] References Cited

U.S. PATENT DOCUMENTS

| | | | |
|---|---|---|---|
| 3,484,677 | 12/1969 | Pitco | 123/148 E |
| 4,090,488 | 5/1978 | Ohki et al. | 123/148 E |

*Primary Examiner*—Ronald B. Cox

*Attorney, Agent, or Firm*—Pearne, Gordon, Sessions, McCoy & Granger

[57] ABSTRACT

A current interruption type ignition system for an internal combustion engine comprises an ignition coil including a primary coil portion and a secondary coil portion; an exciter inducing an AC voltage in synchronism with rotation of the engine to be supplied to the primary coil portion of the ignition coil; a first semiconductor switch provided in parallel to the primary coil portion to conduct a current from the exciter therethrough; a second semiconductor switch provided on a controlled terminal of the first semiconductor switch so that the second semiconductor switch, upon conduction, causes the first semiconductor switch to be turned off so as to abruptly conduct a primary current into the primary coil portion of the ignition coil; and a signal source generating an ignition signal at the ignition position of the engine. The second semiconductor switch is provided in series to the primary coil portion of the ignition coil while the first semiconductor switch has the controlled terminal connected through the primary coil portion of the ignition coil to the exciter, whereby the first semiconductor switch is turned on by a signal applied by the exciter through the primary coil portion of the ignition coil.

4 Claims, 6 Drawing Figures

CURRENT INTERRUPTION TYPE IGNITION SYSTEM FOR AN INTERNAL COMBUSTION ENGINE

BACKGROUND OF THE INVENTION

The present invention relates to a current interruption type ignition system for an internal combustion engine.

There is known in the art a primary current interruption type ignition system for an internal combustion engine comprises an ignition coil including a primary coil portion and a secondary coil portion; an exciter inducing an AC voltage in synchronism with a rotation of the engine to be supplied to the primary coil portion of the ignition engine; a first semiconductor switch provided in parallel to the primary coil portion to conduct a current from the exciter therethrough; a second semiconductor switch provided on a controlled terminal of the first semiconductor switch so that the second semiconductor switch, upon conduction thereof, causes the first semiconductor switch to be turned off so as to abruptly conduct a primary current to the primary coil portion of the ignition coil; and a signal source generating an ignition signal at the ignition position of the engine.

There have been proposed two types of such ignition system. One of them further comprises a trigerring signal generator for the first semiconductor switch. In this system, a trigerring signal generated by the generator causes the first semiconductor switch to be turned on and the current from the exciter to flow through the first semiconductor switch, and then an ignition signal from the signal source causes the second semiconductor switch to be turned on and therefore the first semiconductor switch to be turned off. When the first semiconductor switch is interrupted, the exciter induces a high voltage resulting in a large primary current to the primary coil portion of the ignition coil. Thus, the secondary coil portion of the ignition coil has a high ignition voltage induced to cause an ignition plug to be sparked. In such ignition system, however, the trigerring signal generator for the second semiconductor switch have to be provided in addition to the exciter and the signal source, which causes a whole magneto to be complicated and large-sized, and its cost of production to be inevitably expensive.

Another type ignition system comprises an electrical resistor provided between the exciter and the controlled terminal of the first semiconductor switch and provided in series to the second semiconductor switch. In this system, the first semiconductor switch is turned on by the signal from the exciter through the electrical resistor and turned off by the second semiconductor switch which is turned on by the ignition signal from the signal source so that the primary current is supplied from the exciter to the primary coil portion of the ignition coil. With this system, the trigerring signal generator for the first semiconductor switch can be omitted, but has some drawbacks, which are described below. First, an ignition performance is degraded. More particularly, when the first semiconductor switch is turned off at the ignition position of the engine to generate a high voltage across a coil of the exciter, a current from the exciter passes through the resistor and the second semiconductor switch as well as through the primary coil portion of the ignition coil, which causes the primary current to be decreased, and therefore the ignition voltage to be lowered. Secondly, the first semiconductor switch tends to be broken if the connection of the ignition system is erroneous. More particularly, if the primary coil portion of the ignition coil is erroneously connected or disconnected, the first semiconductor switch has the high voltage applied from the exciter because the primary coil portion is removed out of the system. Thus, the first semiconductor switch is caused to be broken by the high voltage thereacross.

SUMMARY OF THE INVENTION

Accordingly, it is a principal object of the invention to provide a current interruption type ignition system for an internal combustion engine wherein a trigerring signal generator for a first semiconductor switch is not necessary, with the result that it is adapted to be trigerred by a signal from an exciter.

It is another object of the invention to provide a current interruption type ignition system for an internal combustion engine wherein an ignition performance is improved, and as a result a current from an exciter flows only through a primary coil portion of an ignition coil.

It is a further object of the invention to provide a current interruption type ignition system for an internal combustion engine wherein a first semiconductor switch is not broken even if a primary coil portion of an ignition coil is removed out of the ignition system.

In accordance with the invention, there is provided a current interruption type ignition system for an internal combustion engine comprising an ignition coil including a primary coil portion and a secondary coil portion; an exciter inducing an AC voltage in synchronism with rotation of the engine to be supplied to the primary coil portion of the ignition coil; a first semiconductor switch provided in parallel to the primary coil portion to conduct a current from the exciter through the first semiconductor switch; a second semiconductor switch provided on a controlled terminal of the first semiconductor switch so that the second semiconductor switch, upon conduction thereof, causes the first semiconductor switch to be turned off so as to abruptly conduct a primary current from the exciter into the primary coil portion of the ignition coil; and a signal source generating an ignition signal at the ignition position of said engine, characterized in that the second semiconductor switch is provided in series to the primary coil portion of the ignition coil while the first semiconductor switch has the controlled terminal connected through the primary coil portion of the ignition coil to the exciter whereby it is turned on by a signal applied by the exciter through the primary coil portion of the ignition coil.

BRIEF DESCRIPTION OF THE DRAWING

The above and other objects and features of the invention will be apparent from the description of the embodiments taken with reference to the accompanying drawing, in which.

DETAILED DESCRIPTION OF THE EMBODIMENTS

Figure 1:
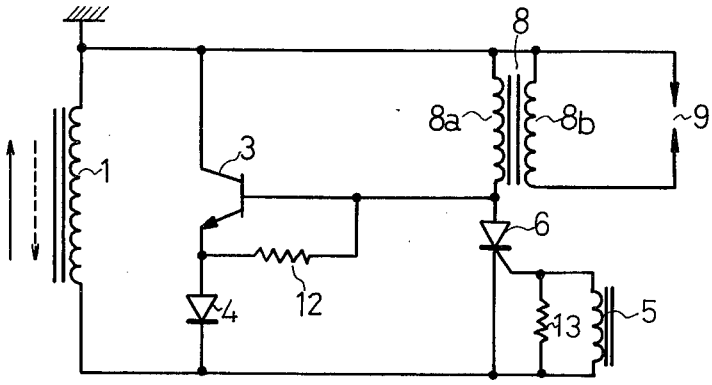
FIG. 1 is a schematic diagram of a typical embodiment of the invention.

FIG. 1 illustrates an embodiment of a current interruption type ignition system for an internal combustion engine in accordance with the invention. This ignition system comprises an exciter 1 provided in a magneto driven by an internal combustion engine and including an exciter coil which induces an AC voltage in synchronism with rotation of the engine. A first semiconductor switch such as a transistor 3 has a collector and an emitter connected through a diode 4 in parallel to the exciter coil of the exciter 1 and has an electrical resistor 12 connected across a base and the emitter of the transistor 3. An ignition coil 8 has a primary coil portion 8*a* connected in series to a second semiconductor switch such as a thyristor 6. Thus, it will be noted that an output voltage from the exciter coil of the exciter 1 is applied across the series connection of the primary coil portion 8*a* of the ignition coil 8 and the thyristor 6. An electrical resistor 13 and a signal source 5 are connected across the gate and cathode of the thyristor 6. The ignition coil 8 has a secondary coil portion 8*b* connected to an ignition plug 9 which is provided in one of cylinders of an internal combustion engine. The signal source 5 may be of such a type as induces an ignition timing signal at the ignition position of the engine.

Figure 2A:
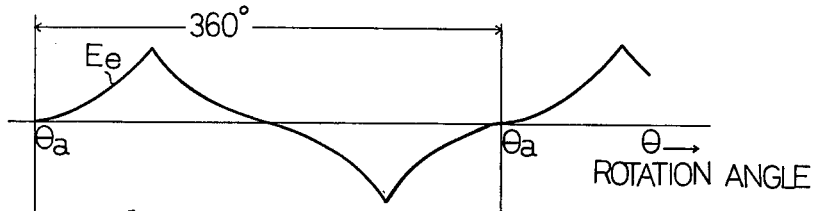
FIGS. 2A through 2D illustrate curves of voltage and current waveforms at the various portions of the ignition system.
Figure 2B:
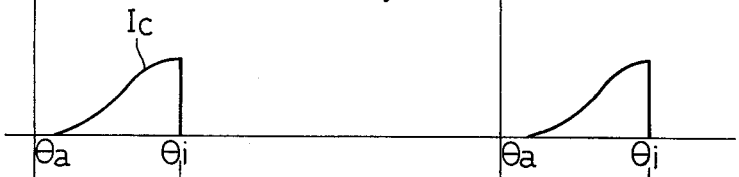
Figure 2C:
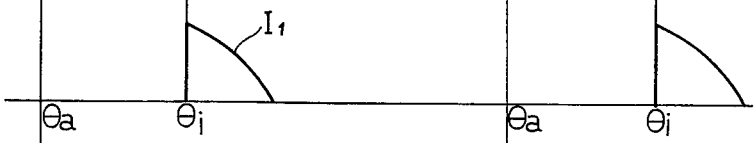
Figure 2D:
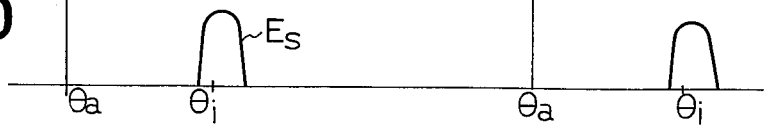

FIGS. 2A through 2D show waveforms of a no-load voltage $E_e$ of the coil of the exciter 1, a collector current $I_c$ of the transistor 3, a primary current $I_1$ of the ignition coil 8 and an ignition timing signal $E_s$ from the signal source 5, with the horizontal axis of the rotation angle $\theta$ of the crank shaft of the engine. As shown in FIG. 2A, when a voltage of positive half cycle (a voltage having the solid arrow direction shown in FIG. 1) is generated at the angle $\theta_a$ of the crank shaft, a base current $I_b$ flows through the primary coil portion of the ignition coil 8, the base and emitter of the transistor 3, and through the diode 4, and as a result, the transistor 3 is turned on so that the collector current $I_c$ flows through the transistor 3 as shown in FIG. 2B. The collector current $I_c$ equals the base current $I_b$ multiplied by the current amplification hfe, and hfe$>>1$, so that almost all of the current from the exciter coil of the exciter 1 flows through the collector and emitter of the transistor 3 and then through the diode 4. At the ignition position $\theta_i$ of the engine, the signal source 5 generates the ignition timing signal $E_s$ as shown in FIG. 2D, and when this signal reaches a sufficient level for trigering the gate of the thyristor 6, the latter is turned on. It will be noted from FIGS. 2A through 2D that the ignition position $\theta_i$ is set at the position where the collector current $I_c$ becomes nearly the largest. The conduction of the thyristor 6 causes the base of the transistor 3 to becomes at the same potential as the emitter of the transistor 3. This causes the base current of the transistor 3 to be interrupted whereby the transistor 3 is abruptly turned off. Thus, the abrupt change in the current causes a high voltage to be induced in the exciter coil in the direction shown at a solid line in FIG. 1. This high voltage of the exciter coil is applied across the series connection of the primary coil portion 8*a* of the ignition coil and the thyristor 6. Since the thyristor 6 is already in the conductive condition, the application of the high voltage across the series connection causes a large current to abruptly flow through the primary coil portion 8*a* of the ignition coil 8 and through the thyristor 6 as shown in FIG. 2C. A high voltage is induced across the secondary coil portion 8*b* of the ignition coil by the primary current abruptly flowing through the primary coil portion 8*a*. Thus, the ignition plug 9 is sparked. It will be noted that the diode 4 serves to protect the transistor 3 from reverse voltage generated by the exciter coil of the exciter.

Figure 3:
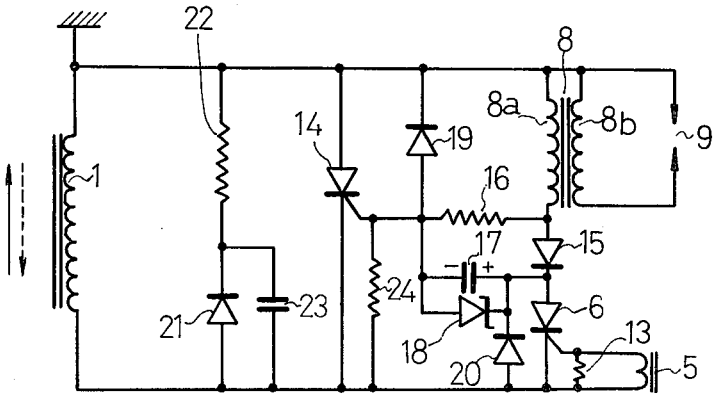
FIG. 3 is a schematic diagram of another embodiment of the invention.

FIG. 3 shows another embodiment of the invention wherein the first semiconductor switch comprises a gate turn off thyristor hereinafter referred to as GTO 14 which at both ends are connected to the exciter coil of the exciter 1. A diode 15 is provided between the primary coil portion 8*a* of the ignition coil 8 and the thyristor 6 and the gate of the GTO 14 is connected through a resistor 16 to the junction of the primary coil portion 8*a* and the diode 15. There is connected between the gate of the GTO 14 and the anode of the thyristor 6, a capacitor 7 to which a Zenor diode 18 is connected in parallel. Diodes 19 and 20 are provided to connect both terminals of the capacitor 17 to the respective ends of the exciter coil of the exciter 1, as shown in FIG. 3, so that the capacitor 17 is charged into a polarity as shown in FIG. 3, when the voltage of the exciter coil of the exciter 1 is in a direction indicated by the arrow of dotted lines. Connected between the anode and cathode of the GTO 14 is a series connection of a diode 21 and a resistor 22, the latter having a capacitor 23 connected to both ends thereof. A resistor 24 is connected in parallel to the gate and cathode of the GTO 14.

In the system of FIG. 3, when the exciter coil of the exciter 1 generates a voltage as shown by dotted lines in FIG. 3, the capacitor 17 is charged through the diodes 20 and 19 into the polarity shown in FIG. 3. When the exciter coil of the exciter 1 generates a voltage as shown by a solid line in FIG. 3, a firing signal is applied through the primary coil portion 8*a* of the ignition coil and through the resistor 16 to the GTO 14, which is therefore turned on, so that a current flows from the exciter coil through the GTO 14. At the ignition position, the output signal of the signal source 5 reaches a level for triggering the gate of the thyristor 6, and the thyristor 6 is thereby turned on, so that the voltage of the capacitor 17 is applied across the gate and cathode of the GTO 14 in a reverse direction. This causes the GTO 14 to be turned off. At that time, the exciter coil of the exciter 1 induces a high voltage, which is applied through the diode 15 and the thyristor 6 to the primary coil portion 8*a* of the ignition coil 8. Thus, a large primary current flows through the primary coil portion 8*a*, which causes the secondary coil portion 8*b* to induce a high voltage. This high voltage sparks the ignition plug 9. It will be noted that the capacitor 23 serves to protect the anode and cathode of the GTO from the high voltage which may be generated across the exciter coil when the GTO 14 is turned off.

It should be noted that since the firing signal for the first semiconductor switch such as the transistor 3 or the GTO 14 is supplied from the exciter through the primary coil portion 8*a*, no firing signal source is necessary and as a result the system is simplified. It should be also noted that since the current from the exciter flows only through the primary coil portion 8*a* of the ignition coil at the interruption of the first semiconductor switch, a change in the primary current for the ignition coil can be fully enlarged, so that the ignition performance can be further improved. As noted from FIGS. 1 and 3, even if the primary coil portion 8*a* of the ignition coil 8 is disconnected from the ignition system, a high voltage is not induced across the exciter, because the second semiconductor is not turned on and as a result the first semiconductor switch can be conductive whenever the exciter produces a positive output. Thus, the semiconductor switch is fully protected from application of a high voltage from the exciter.

It should be also noted that the second semiconductor switch may comprise any of other types of semiconductor switches including a transistor, in place of the thyristor 6 which is used in the afore-mentioned embodiments. It should be understood that a waveform shaping circuit for pulsating the output signal from the signal source 5 may be provided between the signal source 5 and the gate of the thyristor 6.

Although two embodiments of the invention are illustrated and described with reference to the accompanying drawing, it will be understood by those skilled in the art that various changes and modifications may be made without departing from the spirit and scope of the invention, which is intended to be defined only to the appended claims.

What is claimed is:

1. A current interruption type ignition system for an internal combustion engine comprising an ignition coil including a primary coil portion and a secondary coil portion; an exciter incuding an AC voltage in synchronism with rotaton of said engine to be supplied to said primary coil portion of said ignition coil; a first semiconductor switch provided in parallel to said primary coil portion to conduct a current from said exciter through said first semiconductor switch; a second semiconductor switch provided on a controlled terminal of said first semiconductor switch so that said second semiconductor switch, upon conduction thereof, causes said first semiconductor switch to be turned off so as to abruptly conduct a primary current from said exciter into said primary coil portion of said ignition coil; and a signal source generating an ignition signal at the ignition position of said engine, characterized in that said second semiconductor switch is provided in series to said primary coil portion of said ignition coil while said first semiconductor switch has the controlled terminal connected through said primary coil portion of said ignition coil to said exciter whereby said first semiconductor switch is turned on by a signal applied by said exciter through said primary coil portion of said ignition coil.

2. A current interruption type ignition system as set forth in claim 1, wherein said first semiconductor switch comprises a transistor having a collector and an emiter connected to said exciter and having a base connected to the junction of said primary coil portion of said ignition coil.

3. A current interruption type ignition system as set forth in claim 1, wherein said first semiconductor switch comprises a gate turn off thyristor having an anode and a cathode connected to said exciter and having a gate connected to the junction of said primary coil portion of said ignition coil and said second semiconductor switch, and further comprising means to turn off said gate turn off thyristor when said second semiconductor switch is turned on.

4. A current interruption type ignition system as set forth in claim 3, wherein said means to turn off said gate turn off thyristor comprises a capacitor so arranged to be charged when said exciter induces a voltage in the direction reverse to that in which said ignition coil is energized, and so arranged to be discharged through said cathode and gate of said gate turn off thyristor so as to turn off said gate turn off thyristor when said second semiconductor switch is turned on.

* * * * *